US005266450A

United States Patent [19]

Takehara

[11] Patent Number: 5,266,450

[45] Date of Patent: Nov. 30, 1993

[54] SILVER HALIDE PHOTOGRAPHIC LIGHT-SENSITIVE MATERIAL

[75] Inventor: Hiroshi Takehara, Minami-ashigara, Japan

[73] Assignee: Fuji Photo Film Co., Ltd., Kanagawa, Japan

[21] Appl. No.: 900,139

[22] Filed: Jun. 18, 1992

[30] Foreign Application Priority Data

Jun. 21, 1991 [JP] Japan ..... 3-150359

[51] Int. Cl.[5] ..... G03C 1/035

[52] U.S. Cl. ..... 430/502; 430/567; 430/569

[58] Field of Search ..... 430/567, 569, 502

[56] References Cited

U.S. PATENT DOCUMENTS

| | | | |
|---|---|---|---|
| 4,142,900 | 3/1979 | Maskasky | 430/567 |
| 4,471,050 | 9/1984 | Maskasky | 430/567 |
| 4,923,793 | 5/1990 | Shibahasa | 430/567 |
| 5,011,767 | 4/1991 | Yamashita et al. | 430/567 |

FOREIGN PATENT DOCUMENTS

| | | | |
|---|---|---|---|
| 0431585 | 6/1991 | European Pat. Off. | 430/567 |
| 63-220238 | 9/1988 | Japan . | |
| 63-264740 | 11/1988 | Japan . | |
| 1-302247 | 12/1989 | Japan . | |

OTHER PUBLICATIONS

The Theory of the Photographic Process, 4th edition, James (1977), pp. 19–21.

*Primary Examiner*—Charles L. Bowers, Jr.
*Assistant Examiner*—John A. McPherson
*Attorney, Agent, or Firm*—Birch, Stewart, Kolasch & Birch

[57] ABSTRACT

A silver halide photographic light-sensitive material comprising a support, and a plurality of silver halide emulsion layers formed on the support, at least one of the emulsion layers containing regular silver halide grains, at least 30% or more of which have dislocation lines internally, and the sensitivity specks in each of the grains having dislocation lines being distributed with the maximal value at the depth of about at least about 2 nm and less than 50 nm from the surface of the silver halide grains. The regular silver halide grains have a diameter of about 0.1 to 5.0 μm, a variation coefficient of 20% or less in terms of the distribution of their sizes. Each of the grains has a surface comprising, mainly, a (100) face. The grains have high sensitivity achieved by increasing latent image forming efficiency, not light absorption. The light-sensitive material has a high storage stability.

9 Claims, No Drawings

SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material, and more particularly to silver halide photographic light-sensitive material which excel in sensitivity and has its sensitivity little decreased after storage.

2. Description of the Related Art

In recent years, it has been increasingly demanded that the properties of silver halide photographic emulsions, in particular sensitivity, graininess, and sharpness, be improved to high levels. To meet the demand, it is proposed in, for example, U.S. Pat. Nos. 4,434,226 and 4,414,310, that tabular grains having an aspect ratio of 8 or more be used to improve the sensitivity-to-graininess ratio. To improve the sensitivity-to-graininess ratio by the use of tabular grains, it is important to allow a great amount of a sensitizing dye to be adsorbed by the grains according to the large surface area depended on the shape of each tabular grain, thereby to increase the light-absorption efficiency of the grains. Even if the light-absorption efficiency is increased, a sufficient amount of light may fail to reach an underlying emulsion layer. It followed that the sensitivity of the underling layer is impaired in some cases. In view of this, it is necessary to improve the latent-image forming efficiency, not the light-absorption efficiency, of the grain in order to increase the sensitivity of the emulsion.

The inventors thereof studied to see if the sensitivity of a silver halide emulsion can be increased by using regular silver halide grains, thereby enhancing the latent image forming efficiency, not the light-absorbing efficiency, of the silver halide emulsion.

Most spectral sensitizing dyes tend to deteriorate the latent image forming efficiency of a silver halide emulsion. (This efficiency is evaluated in terms of the number of photons each grain needs to absorb in order to form a latent image.) Hence, only in case that spectral sensitizing dyes are used in an amount far less than the amount required to form a continuous mono-molecular layer on the grain, suitable spectral sensitization can be achieved.

An emulsion hitherto known as effective to this problem is a so-called "internal latent image type emulsion" containing grains each having a ripening speck (hereinafter referred to as "sensitivity speck") which can form a latent image capable of being developed when the emulsion is exposed to light. U.S. Pat. No. 3,979,213, for example, teaches that the intrinsic desensitization occurred when an internal latent image type emulsion is spectral-sensitized is much less than that of an emulsion containing silver halide grains which have the same grain size and chemically sensitized in the surface only, and can therefore be effectively spectral-sensitized by using a great amount of a sensitizing dye. As is known in the art, such an emulsion has high storage stability since the sensitivity specks of the grains are not exposed out of the surface.

This type of an emulsion cannot be developed sufficiently, however, even it is processed with a developing solution designed for developing black-white color negative light-sensitive materials and color-reversal light-sensitive materials. After all, the sensitivity is not substantially sufficient. To solve this problem, it is proposed in JP-A-63-264740 and JP-A-1-302247, for example, that the distribution of the latent images be set at the maximum value in the very shallow region from the surface of each gain, thereby to increase the sensitivity and graininess of the emulsion. ("JP-A" means Published Unexamined Japanese Patent Application). If the latent image distribution is set at the maximum value in the shallow region from the surface of the grain, however, the internal latent image type emulsion can no longer have a sufficiently small intrinsic desensitization when it is spectral-sensitized. Thus, the sensitivity and graininess of the emulsion should better be improved further.

The inventors have found it possible to improve the sensitivity and graininess of an internal latent image type emulsion processed with an practically used developing solution, by introducing dislocation lines into the grains the emulsion contains.

Methods of observing dislocations within silver halide grains are described in many theses, among which are:

1. C. R. Berry, J. Appl Phys., 27, 636 (1956)
2. C. R. Berry, D. C. Skilman, J. Appl. Phys., 35, 2165 (1964)
3. J. F. Hamiltion, J. Phot. Sci. Eng., 11, 57 (1967)
4. T. Shiozawa, J. Soc. Phot. Sci. Jap., 34, 16(1971)
5. T. Shiozawa, J. Soc. Phot. Sci. Jap., 35, 213(1972)

These teach that the dislocations in crystals can be observed by means of X-ray diffraction method or transmission electron microscope method at low-temperature. Also do they disclose that various types of dislocations are generated in crystals when strain is applied, on purpose, to the crystals.

However, it is not that dislocations have been intentionally introduced into the silver halide grains described in these theses. Silver halide grains into which dislocations have been introduced on purpose are disclosed in JP-A-63-220238 and JP-A-1-201649. These publications teach that tabular silver halide grains having some dislocation lines introduced into them have better photographic properties, such as sensitivity and reciprocity law, than tabular grains having no dislocation lines. Also is it described in the theses that a light-sensitive material containing the tabular grains having dislocation lines excels i sharpness and graininess. However, tabular silver halide grains having dislocation lines and possessing satisfactory properties have yet to be available. Nor has any report been made on regular grains into which dislocations have been positively introduced.

SUMMARY OF THE INVENTION

Accordingly, the object of the present invention is to provide a silver halide photographic light-sensitive material which not only has high sensitivity but also excels in storage stability. More specifically, the object is to provide regular silver halide grains which have high sensitivity achieved by increasing latent image forming efficiency, not light absorption, and also a silver halide photographic light-sensitive material comprising an emulsion which contains these grains.

The object has been attained by a silver halide photographic light-sensitive material which comprises a support and a plurality of silver halide emulsion layers formed on the support, at least one of the emulsion layers containing regular silver halide grains, at least 30% or more of which have dislocation lines internally, and the sensitivity specks in each of the grains having dislocation lines being distributed with the maximal value at the depth of about at least 2 nm and less than 50 nm from the surface of the silver halide grain.

In a preferred embodiment according to the invention, the light-sensitive material contains regular grains, each having a surface comprising, mainly, a (100) face.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

At lease one of the emulsions layers of the silver halide photographic light-sensitive material according to the invention comprises preferably negative-type silver halide grains. These grains are regular grains, i.e., grains each having a regular crystal shape, such as cubic grains, octahedral grains, dodecahederal grains, or tetradecahedral grains.

Preferably, the surface of each regular grain comprises mainly (100) faces. This means that the ratio P (%) of the area of the (100) face to the entire surface area of the grain is 70% or more, more preferably 80% or more. The ratio P (%) can be determined by the method disclosed in T. Tani, Journal of Imaging Science, 29, 165 (1985).

Generally, when grains whose surfaces comprising mainly (100) faces are examined by means of an electron microscope, most of them are found to be cubic grains. Hence, cubic grains are preferable for the use in the emulsion according to the present invention.

The emulsion used in the invention contains regular grains which have a diameter of about 0.1 to 5.0 μm, more preferably 0.3 to 1.5 μm. It is desirable that the emulsion has a variation coefficient of about 20% or less, in terms of the size distribution of the regular grains.

The regular silver halide grains in at least one emulsion layer of the light-sensitive material according to the invention have dislocation lines each. Dislocations in silver halide grains can be observed by a direct method disclosed in J. F. Hamiltion, Phot. Sci. Eng., 11, 57 (1967) and T. Shiozawa, J. Soc. Phot. Sci. Jap., 35, 213(1972), in which use is made of a transmission electron microscope at low temperatures. More specifically, silver halide grains are picked up extracted from the emulsion, not applying so high a pressure as to cause dislocations in the grains, are place on a mesh designed for use in electron microscope observation, and are observed by a transmission method under cooling the sample not to have damages (e.g., printouts) due to an electron beam. Then, photos of the sample are taken by the camera attached to the microscope. The thicker the grains, the more hard it is for an electron beam to pass through the grains. Hence, a high-voltage type electron microscope should better be employed to make a clear observation of the grains. (For example, 200 KV or more be applied to the microscope to observe a grain having a thickness of 0.25 μm.) In the photos thus taken, the dislocation lines in each grain can be located and counted.

In said at least one emulsion layer of the light-sensitive material according to the invention, at least 30% of the regular silver halide grains have dislocation lines, preferably 10 or more dislocation lines each. More preferably, 80% or more of the regular grains contained in said at least one emulsion layer have 10 or more dislocation lines each.

Dislocations can be formed, either uniformly in the regular silver halide grain, or locally in a particular portion thereof. However, it is desirable that dislocations be formed concentratedly in a region near an apex of the grain. The phrase "region near an apex of the grain" means a polygonal region which is defined by the lines connecting the points at which the lines extending from the midpoint of a line extending from the center of the grain to an apex thereof intersect at right angles with the ridges meeting at that apex, the lines connecting said points, and the lines extending from said points to that apex. In the case where the grain is somewhat rounded and therefore has vague apices, the point at which tangents to the ridges extending from one point meet is assumed to be an apex. The words "dislocations be concentratedly formed substantially in a region near an apex of the grain" means that the density of the dislocations is higher than any portions other than the region near the apex. The density of dislocations is the number of dislocation lines per unit area.

The regular silver halide grains used in the light-sensitive material of the present invention have halogen compositions comprising silver bromoiodide, silver bromide and silver bromochloroiodide. The structure of the halogen composition in the grain can be of uniform, double-structured, or multilayered. The grain can have a phase having a high AgI content in the center (internal) portion, the surface, or the intermediate portion. The grain can have, within it, a silver halochloride layer, a silver thiocyanate layer, or a silver citrate layer, which has been halogen-converted.

In the present invention, to introduce dislocations into each regular silver halide grain, a silver halide having a high AgI content is grown on the host grain, and then a silver halide shell having a low AgI content is formed, covering the silver halide having a high AgI content.

The host grain can preferably comprise silver bromoiodide or silver bromochloroiodide. It is disirable that the silver bromiodide host grain contains 10 mol % or less, more preferably 3 mol % or less, of silver lodide. On the other hand, it is desirable that the silver bromochloroiodide host grain contains 3 mol % or less of silver chloride and 10 mol % or less, more preferably 3 mol % or less, of silver iodide.

The silver halide having a high-AgI content preferably can comprise silver bromoiodide or silver bromochloroiodide. It is desirable that the silver bromoiodide grain contains 30 mol % or more, more preferably 90 mol % or more, of silver iodide. On the other hand, it is desirable that the silver bromochloriodide grain contains 5 mol % or less of silver chloride and 30 mol % or more, more preferably 90 mol % or more, of silver iodide.

Generally, the silver halide grains having a high-AgI content is formed by adding potassium iodide to an emulsion containing host grains and by subjecting the resultant emulsion to halogen conversion. Grains of the silver halide thus formed are not desirable since they differ in their silver iodide content. As will be described later, silver halide grains will have the same silver iodide content if each is formed by forming silver chloride on a host grain comprising silver iodide and then adding potassium iodide under carefully selected conditions. Another preferable method of forming silver halide grains having the same silver iodide content is to add an aqueous solution of silver nitrate and an aqueous solution of potassium bromide, potassium iodide, or mixture of these, to an emulsion containing host grains, by means of double-jet method. In this method, it is recommendable that the AgI value be maintained constant.

The silver halide shell having a high AgI content can be a layer covering a host grain or can be epitaxially formed on the host grain. It is more preferable that the silver halide be epitaxially formed on each host grain.

The silver halide shell having a low AgI content preferably comprises silver bromoiodide or silver bromochloroiodide. It is desirable that the silver bromoiodide shell contains 6 mol % or less, more preferably 3 mol % or less, of silver iodide. On the other hand, it is desirable that the silver bromochloroiodide shell contains 1 mol % or less of silver chloride and 6 mol % or less, more preferably 3 mol % or less, of silver iodide.

A method of epitaxially forming silver iodide on a host grain which has a face-centered cubic rock-salt type structure is disclosed in JP-A-59-162540. This publication teaches that, in this method, silver salt which has a crystal structure different from that of the host grain can be epitaxially formed on the host grain. Thus, silver iodide is epitaxially grown on the host grain, and, if necessary, the host grain is again grown thereafter, thereby introducing dislocations into the silver halide grain.

It will be described how to introduce dislocations into a regular grain, concentratedly in a region near an apex of the grain.

There are two alternative methods of introducing dislocations into a grain, concentrated in a region near an apex of the grain. In the first method, silver halide having a high AgI content is joined to an apex of the silver halide grain. In the second method, silver halide having a high AgI content is joined to an apex of the grain and then the grain is grown again.

Silver iodide, or silver bromoiodide, silver bromochloroiodide or silver chloroiodide, which has a higher silver iodide content than the host grain, can be joined to an apex of a silver halide grain, either directly or indirectly by means of halogen conversion.

Through their repeated researches and experiments, the inventors hereof have found that silver iodide or silver halide having a high AgI content can be epitaxially joined directly to an apex of a silver halide gain, without applying a site director, by adding a potassium iodide aqueous solution and a silver nitrate aqueous solution to an emulsion containing silver bromoiodide host grains at high speed by means of double-jet method; both aqueous solutions are used in an amount about 0.5 to 10 mol %, preferably 1 to 6 mol % of the host grains. It is desirable that the aqueous solutions be added to the emulsion over 0.5 to 20 minutes, preferably 0.5 to 2 minutes.

Silver iodide or silver halide having a high AgI content can be joined to an apex of a silver halide grain, also by the following method. First, a silver halide solvent is added to a solution containing host grains. Next, a potassium iodide aqueous solution and a silver nitrate aqueous solution are simultaneously added to the resultant solution, or only a potassium iodide aqueous solution is added thereto. Thereafter, a silver halide aqueous solution (containing Br or Br+I) and silver nitrate were added, thereby joining silver halide to an apex of the grain. In this method, both aqueous solutions are not required to be added rapidly. The amount of the solutions added is set at about 0.5 to 10 mol %, preferably 2 to 6 mol % of the host grains.

In the method described above, it is possible to use as the silver halide solvent thiocyanate, ammonia, thioether, or thiourea. Specific examples of the solvent are thiocyanates (e.g., those disclosed in U.S. Pat. Nos. 2,222,264, 2,448,534 and 3,320,069); ammonia; thioether compounds (e.g., those disclosed in U.S. Pat. Nos. 3,271,157, 3,574,628, 3,704,130, 4,297,439 and 4,276,347); thione compounds (e.g., those disclosed in JP-A-53-144319, JP-A-53-82408 and JP-A-55-77737); amine compounds (e.g., those disclosed in JP-A-54-100717); thiourea derivatives (e.g., those disclosed in JP-A-55-2982); imidazoles (e.g., those disclosed in JP-A-54-100717), substituted mercaptotetrazoles (e.g., those disclosed in JP-A-57-202531).

It will now be described how to join silver iodide or silver halide having a high AgI content to an apex of a silver halide grain, indirectly by means of halogen conversion. First, silver chloride is epitaxially grown on a regular grain of silver bromoiodide having a surface ioidine content of 10 mol % or less. As a result, the silver chloride adheres more to the (111) face than any other crystal faces of the grain. Hence, a cubic grain having dislocation lines present concentrated in an apex can be formed by epitaxially growing silver chloride on a tetradecahedral host grain, by subjecting the grain to halogen conversion with potassium iodide, and by growing the grain at pAg value of 7 or less, preferably 5 to 7.

The inventors have found it recommendable to use a water-soluble iodide as a site director in order to epitaxially grow silver chloride. More specifically, potassium iodide should better be used as a site director in an amount of about 0.03 to 3 mol %, preferable 0.5 to 1.5 mol %, based on the host silver halide grain. After the addition of potassium iodide, silver nitrate and potassium chloride, for example, are added by means of double-jet method, silver chloride can be grown on the apex of the silver halide grain, thereby achieving the object of the present invention. Preferably, silver nitrate is added in an amount of 0.1 to 10 mol % based on the host silver halide grain.

The halogen conversion of silver chloride, achieved by using potassium iodide, will be described in detail. A silver halide having a higher solubility can be converted into a silver halide having a less solubility, by adding to it halogen ions which can form a silver halide having a less solubility. This conversion is known as "halogen conversion," as is disclosed in, for example, U.S. Pat. No. 4,142,900. In this invention, the silver chloride epitaxially grown is selectively subjected to halogen conversion using potassium iodide, thereby forming AgI phases in the an apex of the silver halide grain. If the amount of the potassium iodide used for the halogen conversion is too large, the dislocations introduced into the grain will be dispersed. On the other hand, if the amount of the potassium iodide used for the halogen conversion is too small, the dislocations introduced into the grain will no longer exist when the grain is re-crystallized as it is grown further. Unless silver chloride phase exits in an appropriate amount at the time of halogen conversion, the potassium iodide also cause the halogen conversion of silver bromide, and the dislocation lines will no longer concentratedly generate in the grain as the grain is grown further. In view of this, it is desirable that potassium iodide be added in an amount of 0.1 to 10 mol % based on the host silver halide grain.

The method of introducing dislocations into a silver halide grain by growing the grain will be explained in detail.

At the time the silver iodide is directly joined to the host grain, or at the time the halogen conversion is performed, an AgI phase or a silver halide phase having a high AgI content is formed on the silver halide grain. The crystal shape of the AgI phase or the silver halide phase is a different from that of the host grain comprising silver bromide, silver bromoiodide, silver chlorobromide or silver bromochloroiodide. When a mixed solution of silver nitrate and potassium bromide or a mixed solution of silver nitrate, potassium bromide and potassium iodide is added, the grain is grown further. At this time, dislocations generate from the AgI phase. If the AgI phase is locally present in a region near any apex of the grain, it will concentrate in the region near that apex. The amount of silver nitrate added can be of any desirable value, provided it is 5 mol % or more based on the host grain. In the case where a mixed solution of potassium bromide and potassium iodide is added, the mixing ratio of potassium bromide and potassium iodide is preferably 1:0 to 1:0.4.

Another method of introducing dislocations into a silver halide grain is available, in which silver iodide is not used at all. In this method, a number of tiny projections of silver chloride are formed on the host grain, the grain is subjected to physical ripening, and if necessary, silver chrolide is converted with silver iodide so as to remove chlorine. Preferably, the tiny projections of silver chloride are epitaxially formed on the grain at 30° C. to 60° C. at a pAg value of 6.0 to 7.2, and the grain is subjected to physical ripening at 40° C. or more. If necessary, a silver halide solvent can be added.

Also, potassium bromide can be added, if necessary, thereby removing silver chloride by means of halogen conversion. Potassium bromide is used in an amount of 100 to 400 mol %, preferably 100 to 200 mol %, based on the amount of silver required for epitaxially forming the fine silver chloride on the host grain.

The silver halide emulsion for use in the present invention can be chemically sensitized by a gold compound, a sulfur compound, or a selenium compound.

At least one emulsion layers of the light-sensitive material according to this invention comprises a so-called internal latent image type emulsion which contains regular silver halide grains having sensitivity specks, i.e., portions which form a latent image to be developed when the material is exposed to light. The distribution of the sensitivity-specks in any regular silver halide grain having dislocation lines shows a maximal value at a depth of about 2 nm to 50 nm, preferably 5 nm to 30 nm, from the surface of the grain.

The depth at which the distribution of the sensitivity specks shows the maximal value is measured by the following method. First, the silver halide grains are exposed to white light for 1/100 second. Then, the grains are treated as described below, so that the light-sensitive material has a fog density of +0.1. The reciprocal y of the exposure amount which has imparted the fog density of +0.1 to the material is determined. In order to determine the latent-image distribution, the silver halide grains are treated at 20° C. for 7 minutes, with a processing solution which has been prepared by adding 0 to 10 g/liter of sodium thiosulfate to a solution having the following composition.

| (Composition of the Solution) | |
|---|---|
| N-methyl-p-aminophenol sulfate | 2.5 g |
| Sodium L-ascorbate | 10 g |
| Sodium methaborate | 35 g |
| Potassium bromide | 1 g |
| Water to make | 1 l (pH: 9.6) |

The relationship, which the y has with the depth x of the latent image in the silver halide grain, which is developed during said processing, can be determined. The value of x, at which y is maximal, is defined as the depth at which the sensitivity specks exits in the grain.

A light-sensitive material, in which sensitivity specks exist at the depth of 50 nm or more from the surface of each grain, cannot be sufficiently developed, even if it is processed with a developing solution practically used for developing black and white light-sensitive material, color negative light-sensitive materials and color-reversal light-sensitive materials. Consequently, the material is not sufficiently sensitive to light. The "developing solution practically used" is neither a solution containing no silver halide solvent, thereby to develop a latent image of the surface only, nor a solution containing a great amount of a silver halide solvent, thereby to develop an internal latent image.

The internal latent image type emulsion for use in the present invention can prepared by the methods disclosed in, for example, U.S. Pat. Nos. 3,979,213, 3,966,476, 3,206,313 and, 3,917,485, JP-B-43-29405, and JP-B-45-13259. ("JP-B" means Published Examined Japanese Patent Application.) In these methods, the conditions of chemical sensitization, the amount of silver halide to precipitate after the chemical sensitization, and the conditions of precipitating the silver halide must be controlled in order to prepare a emulsion which has the distribution of the latent images according to the present invention.

In an another method, fine silver halide grains can be added, and an internal latent image can be formed by performing Ostwald ripening on the grains. More specifically, as is described in U.S. Pat. No. 3,979,213, an internal latent image type emulsion is prepared by precipitating silver halide again on the grains which have been subjected to chemical sensitization in their surfaces, by means of controlled double jet method.

It is desirable that the silver halide precipitated after the chemical sensitization have a solubility higher than the solubility which the surface regions of the silver halide grains have before the chemical sensitization. To render the precipitated silver halide so soluble, AgBr, AgBrCl, or AgCl fine grains are added in the case where the precipitate silver halide is AgBr.

The silver halide grains, including regular grains, for use in the light-sensitive material of the invention, can be subjected to reduction sensitization, preferably during the forming of grains prior to the forming of sensitivity specks.

To perform reduction sensitization during the forming of silver halide grains is to carry out the sensitization during the nucleation, the ripening of the grains, or the growth thereof. The reduction sensitization can be conducted at any initial stage of the grain-forming, i.e., the nucleation, the chemical ripening of grains, or the growth of grains. The most preferable timing of the reduction sensitization is any time during the growth of grains. Various methods can be employed to perform reduction sensitization during the growth of grains. Among these are: a method of effecting reduction sensitization while silver halide grains are grown by virtue of chemical ripening or addition of a water-soluble silver salt and a water-soluble alkali halide; and a method of suspending the growth of grains, performing reduction sensitization and resuming the growth of grains.

The reduction sensitization, specified above, can be carried out in various ways. It can be achieved by adding a known reduction sensitizer to the silver halide emulsion, by conducting so-called "silver ripening," in which the grains are grown or ripened in a low-pAg atmosphere at a pAg value of 1 to 7, or by carrying out so-called "high-pH ripening," in which the grains are grown or ripened in a high pH atmosphere at a pH value of 8 to 11. The addition of a reduction sensitizer, the silver ripening, and the high-pH ripening can be employed, either singly or in combination. Of these alternative modes of reduction sensitization, the addition of a reduction sensitizer is suitable to the present invention, since this mode can minutely control the level of reduction sensitization.

The reduction sensitizer is one selected from the known sensitizers such as a stannous salt, an amine, a polyamine, a hydrazine derivative, a formamidine sulfinic acid, a silane compound, and a borane compound. Two or more compounds can be used as reduction sensitizers. Preferable reduction sensitizers are: stannous chloride, thiourea dioxide, dimethylaminoborane, ascorbic acid, and ascorbic acid derivative. The reduction sensitizer should be added in an appropriate amount since the amount depends on the conditions of preparing the emulsion. The appropriate amount ranges from $10^{-8}$ to $10^{-3}$ mol per mol of silver halide.

The reduction sensitizer can be added during the forming of grains, dissolved in a solvent such as an alcohol, a glycol, a ketone, an ester, or an amide. It can be supplied into the reaction vessel prior to the forming of grains, but it should better be added at a proper time during the forming of grains. Alternatively, the reduction sensitizer can be added to an aqueous solution of a water-soluble silver salt or a water-soluble alkali halide, and halide, grains can be formed by using this aqueous solution. Further, a solution of the reduction sensitizer can be added intermittently in several portions, or continuously, while the grains are being formed.

In the present invention, a palladium compound is added in an amount of $5\times10^{-5}$ or more, preferably $10^{-3}$ or less, per mol of silver halide, preferably after the grains have been formed.

The term "palladium compound" means a salt of divalent palladium salt or a salt of tetravalent palladium. Preferable palladium compounds are those represented by $R_2PdX_6$ or $R_2PdX_4$, where R is hydrogen, an alkali-metal atom, or ammonium, X is a halogen atom such as chlorine, bromine or iodine. Specific examples of the preferable palladium compound are: $K_2PdCl_4$, $(NH_4)_2PdCl_6$, $Na_2PdCl_4$, $(NH_4)_2PdCl_4$, $Li_2PdCl_4$, $Na_2PdCl_6$, and $K_2PdBr_4$.

Most preferably, one of these palladium compounds is used, along with thiocyanic ions used in an amount of 5 times or more the amount of the palladium compound in terms of mol.

It is desirable that the photographic emulsion used in the invention be subjected to spectral sensitization.

The spectral sensitizer usually used in the present invention is a methine dye. Examples of this dyes are: a cyanine dye, a melocyanine dye, a composite cyanine dye, a composite melocyanine dye, a holopoler cyanine dye, a hemicyanine dye, a stylyl dye, and a hemioxonol dye. These dyes contains nuclei which are usually used in cyanine dyes as basic heterocyclic nuclei. Examples of the nuclei are nuclei such as pyrroline, oxazoline, thiazoline, pyrrole, oxazole, thiazole, selenazole, imidazole, tetrazole, and pyridine; nuclei each formed of any one of these nuclei and an alicylic hydrocarbon ring fused to the nucleus; and nuclei each formed of any one of these nuclei and an aromatic hydrocarbon ring fused to the nucleus, such as indolenine, benzindolenine, indole, benzoxazole, naphthoxazle, benzoxazole, naphthothiazole, benzoselenazole, benzimidazole, and quinoline. These nuclei can be substituted at any of carbon atoms.

A melocyanine dye or composite melocyanine dye can be one which has nuclei of a ketomethylene structure. Applicable as such nuclei are 5- or 6-membered heterocyclic nuclei such as pyrazoline-5-on, thiohydantoin, 2-thiooxazoline-2,4-dione, thiazolidine-2,4-dione, rhodanine or thiobarbituric acid.

Of the dyes mentioned above, particularly useful in the present invention is a cyanine dye. Specific examples of the cyanine dye are those represented by the following formula (I):

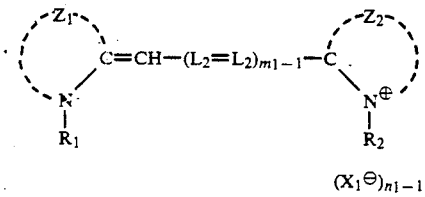

Formula (I)

In the formula (I), each of $Z_1$ and $Z_2$ is an atom group required for forming a heterocyclic nucleus, particularly thiazole, thizoline, benzothiazole, naphthothiazole, oxazole, oxazoline, benzoxazole, naphthooxazole, tetrazole, pyridine, quinoline, imidazoline, imidazole, benzoimidazole, naphthoimidazole, selenazoline, selenazole, benzoselenazole, naphthoselenazole, or indolenine. These nuclei can be substituted by lower alkyl groups such as methyl, halogen atoms, phenyl groups, hydroxyl groups, alkoxy grlups having 1 to 4 carbon atoms, carboxyl groups, alkoxycarbonyl groups, alkylsulfamoyl groups, alkylcarbamoyl groups, acetyl groups, acetoxy groups, cyano groups, trichloromethyl groups, trifluoromethyl groups, or nitro groups.

In the formula (I), each of $L_1$ and $L_2$ is a methine group or substituted methine group. Examples of the substituted methine group are that substituted by a lower alkyl group such as methyl, ethyl, phenyl, substituted phenyl, methoxy or ethoxy.

Each of $R_1$ and $R_2$ is an alkyl group having 1 to 5 carbon atoms; a substituted alkyl group having a carboxy group; a substituted alkyl group having a sulfo group such as β-sulfoethyl, γ-sulfopropyl, δ-sulfobutyl, 2-(3-sulfopropoxy)ethyl, 2-[2-(3-sulfopropoxy)ethoxy]ethyl, or 2-hydroxy sulfopropyl; an allyl group; and a substituted alkyl group usually used in a N-substituting group of a cyanine dye.

In the formula (I), $m_1$ is 1, 2 or 3, $X_{1-}$ is an acid anion group usually used in a cyanine dye, such as an iodide ion, bromide ion, p-toluenesulfonic ion, perchloric ion, and $n_1$ is 1 or 2. If the cyanine dye is of betaine structure, $n_1$ is 1.

In the present invention, it is desirable that the silver halide emulsion be subjected to the sectral sensitization with two or more of sensitizing dyes represented by the formula (I).

Spectral sensitizing dyes other than those specified above, which can be used in the present invention, are disclosed in German Patent 929,080, U.S. Pat. Nos. 2,493,748, 2,503,776, 2,519,001, 2,912,329, 3,656,956, 3,672,897, 3,694,217, 4,025,349, 4,046,572, 2,688,545, 2,977,229, 3,397,060, 3,552,052, 3,527,641, 3,617,293, 3,628,964, 3,666,480, 3,672,898, 3,679,428, 3,703,377, 3,814,609, 3,837,862 and 4,026,344, British Patents 1,242,588, 1,344,281 and 1,507,803, JP-B-44-14030, JP-A-52-110618, JP-A-52-109925, and JP-A-50-80827.

The amount in which to add the sensitizing dye during the preparation of the silver halide emulsion can not be determined by only the types of additives used and the amount of the silver halide used, but can be the amount added in the conventional method of preparing a silver halide emulsion, i.e, 50 to 80% of the saturated coating amount.

More specifically, the sensitizing dye should be added in an amount of 0.001 to 100 mmol, preferably 0.01 to 10 mmol per mol of silver halide.

The sensitizing dye can be added during the forming of silver halide grains, during the chemical sensitization of the emulsion, or immediately before the emulsion is coated.

To add the sensitizing dye during the forming of silver halide grains, the methods disclosed in U.S. Pat. Nos. 4,225,666 and 4,828,972, and JP-A-61-103149 can be employed. To add the sensitizing dye during the desalting of the silver halide emulsion, the methods disclosed in European Patent 291,339-A and JP-A-64-52137 can be used. Further, to add the sensitizing dye during the chemical sensitization of the emulsion, the method disclosed in JP-A-59-48756 can be adopted.

The emulsion can contain not only the sensitizing dye, but also a dye which has no sensitizing ability or a substance which absorbs virtually no visible light and has supersensitizing ability. Examples of such a dye and a substance are: aminostyl compounds substituted by nitrogen-containing heterocyclic groups (e.g., those compounds disclosed in U.S. Pat. Nos. 2,933,390 and 3,635,721), aromatic organic acid-formaldehyde condensates (e.g., those disclosed in U.S. Pat. No. 3,743,510), cadmium salts, or azaindene compounds. A combination of the compounds disclosed in U.S. Pat. Nos. 3,615,613, 3,615,641, 3,617,295 and 3,635,721) is particularly useful.

The photographic emulsion used in the invention can contain various compounds to prevent fogging from occurring during the manufacture, storage or processing of the light-sensitive material, and to stabilize the photographic properties of the light-sensitive material. More precisely, compounds known as antifoggants and stabilizing agents can be added to the emulsion. Examples of these compounds are: azoles such as benzothiazolium salt; nitroindazoles; triazoles, benzotriazoles; benzimidazoles (particularly, nitro- or halogen-substituted); heterocyclic mercapto compounds such as mercaptothiazoles, mercapotobenzothiazoles, mercaptobenzimidazoles, mercaptotetrazoles (partivularly, 1-phenyl-5-mercapto tetrazole); mercaptopyrimidines; heterocyclic mrcapto compounds having water-soluble groups such as carboxyl groups or sulfon groups; thioketo compounds such as oxazolinethione; azaindenes such as triazaindene and tetrazaindene (particularly, 4-hydroxy-substituted (1, 3, 3a, 7) tetraazaindenes); benzenethiosulfonic acids; and benzenesul finic acids.

These antifoggants and stabilizing agents are added, usually after the emulsion has been subjected to the chemical senstization. Nonetheless, they should better be added either before or during the chemical sensitization. In other words, they can be added at any time during the forming of the grains, i.e., during the addition of the silver salt solution, after the addition of the silver salt solution and before the start of the chemical sensitization, or during the chemical sensitization. (In the case where the antifoggants and stabilizing agents are added during the chemical sensitization, the addition should be completed, preferably within 50%, preferably 20% of the chemical-sensitization period, from the start of the chemical sensitization.

Specific examples of the antifoggants and stabilizing agents are: hydroxyazaindene compounds, benzotriazole compounds, and heterocyclic compounds each substituted by at least one mercapto group and having at least two azanitrogen atoms in the molecule.

The silver halide emulsion for use in the present invention can be prepared by methods described in, for example, P. Glafkides, "Chimie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964. In other words, the emulsion can be prepared by an acidification method, a neutralization method, or an ammonification method. To react a soluble silver salt with soluble halogen salt, the single-jet method or the double-jet method, or both can be employed. Silver halide grains can be formed by means of so-called "reversal mixing," in which the grains are formed in the presence of an excessive amount of silver ions. One of the double-jet methods is so-called "controlled double-jet method," in which pAg in the liquid phase in which silver halide grains is prepared at a prescribed value. This method can be used in this invention, thereby to obtain silver halide grains each of which has a regular crystal shape and a virtually uniform size.

The silver halide emulsion for use in this invention can be obtained by controlling the pAg value and the pH value during the forming of grains, as is detailed in, for example, "Photographic Science and Engineering," Vol. 6, pp. 159–165 (1962); "Journal of Photographic Science," Vol. 12, pp. 242–252 (1964); and U.S. Pat. Nos. 3,655,394 and 1,413,748.

The light-sensitive material according to the invention will be explained with respect to the other points than those described above in detail as follows.

The silver halide grains used in the light-sensitive material comprise a core and a shell each, said core having the same shape as the grain including the shell as whole or a shape different from that of the grain. More specifically, the core may be cubic, whereas the grain with the outermost shell is cubic or octahedral. Conversely, the core may be octahedral, whereas the grain with the outermost shell is cubic or octahedral. Alternatively, the core may have a regular shape, whereas the grain is slightly deformed or amorphous.

Each grain having this structure can have either a distinct boundary region or an indistinct boundary region between the regions having different halogen compositions. In the case, they have an indistinct boundary region, the boundary one is formed of mixed crystals depending on the difference between the compositons. Alternatively, the boundary region can be formed to have a composition which gradually changes from one region to the other.

The silver halide emulsion for use in the present invention can be processed, thereby rounding the grains as is described in, for example, EP-0096727B1 and EP-0064412Bl, or thereby modifying the surface of each grain as is described in DE-2306447C2 and JP-A-60-221320.

A silver halide solvent is useful for accelerating the ripening of the emulsion. As known in the art, an excessive amount of halogen ions is introduced in the reaction vessel. Therefore, the solution of the silver halide salt can only be introduced into the vessel so as to permit accelerating the ripening. Any other ripening agent can be used for the same purpose. The ripening agent can be applied in various manners. For example, the total amount of it is added to the dispersion medium contained in the reaction vessel, before silver and a halide salt are introduced into the vessel. Alternatively, it can be introduced into the reaction vessel, along with at least one or more halide salt, silver salt, and deflocculant. Still alternatively, it can be introduced into the vessel independently of the halide salt and the silver salt.

Examples of ripening agents other than halogen ions, which can be used in the invention, are: ammonia; amine compounds; and thiocyanates, e.g., alkali metal thiocyanate, particularly sodium thiocyanate and potassium thiocyanate, and ammonium thiocyanate.

A cadmium salt, zinc salt, thallium salt, iridium salt or complex salt thereof, rhodium slat or complex salt thereof, or iron salt or complex salt thereof can be present in the silver halide emulsion for use in the invention, while grains are being formed or ripened in the emulsion.

The light-sensitive material containing the emulsion described above can be used as various color light-sensitive materials or various black and white light-sensitive materials. Typical examples of these are: a color negative film for a general purpose or movies, a color reversal film for a slide or television, a color paper, a color positive film, a color reversal paper, color-diffusing type light-sensitive materials, and thermally developing type color light-sensitive materials.

The photographic emulsion used in the present invention can be applied to printing film such as a lithographic film or a scanner film, to industrial X-ray film for direct or indirect medical use, a negative black and white film for photography, a black and white photographic paper, a microfilm for COM, an ordinary microfilm, a silver salt-diffusion transfer light-sensitive material, and a print-out type light-sensitive material.

In case that the light-sensitive material of the present invention is used as a color photographic one, it needs only to have at least one of silver halide emulsion layers, i.e., a blue-sensitive layer, a green-sensitive layer, and a red-sensitive layer or a layer sensitive to an infrared light, formed on a support. The number or order of the silver halide emulsion layers and the non-light-sensitive layers are particularly not limited. A typical example is a silver halide photographic light-sensitive material having, on a support, at least one unit of light-sensitive layers constituted by a plurality of silver halide emulsion layers which are sensitive to essentially the same color but have different sensitivities. The light-sensitive material is useful for one having an improved exposure latitude for taking. In a multi-layered silver halide color photographic light-sensitive material, the units of light-sensitive layers are generally arranged such that red-, green-, and blue-sensitive layers are formed from a support side in the order named. However, this order may be reversed or a layer sensitive to one color may be sandwiched between layers each sensitive to another color in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit of light-sensitive layers, a two-layered structure of high- and low-sensitivity emulsion layers can be preferably used as described in West German Patent 1,121,470 or British Patent 923,045. In this case, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in a unit of layers sensitive to one color as described in JP-A-59-202464.

Also, an order of, for example, high-sensitivity emulsion layer/low-sensitivity emulsion layer/medium-sensitivity emulsion layer, or low-sensitivity emulsion layer/medium-sensitivity emulsion layer/high-sensitivity emulsion layer may be adopted.

To improve the color reproduction of the light-sensitive material, it is desirable that a donor layer for interimage effect (CL) having a spectral sensitivity distribution different from that of the main light-sensitive layer such as BL/GL/RL structure should be arranged on or close to the main light-sensitive layer, as is described in U.S. Pat. Nos. 4,663,271, 4.705.744 and 4.707.436. JP-A-62-160448. and JP-A-63-89580.

If the light-sensitive material of this invention is applied to a color negative film or a color reversal film, the silver halide contained in any of its photographic emulsion layers should better be silver bromoiodide, silver iodochloride, or silver bromochloroiodide, which has an average AgI content of 30 mol % or less. Particularly preferable as the silver halide is silver bromoiodide or silver bromochloroiodide, which has an average AgI content of about 2 mol % to about 25 mol %.

The grains in the photographic emulsion for use in the invention can have any average size. Nonetheless, grains having a projected-area diameter of 0.5 to 4 microns are preferred, which can be contained in either a poly-dispersed emulsion or a mono-dispersed emulsion.

Photographic additives, which can be used along with the photographic emulsion for use in the invention, are disclosed in Research Disclosures Nos. 17643 and 18716. These additives will be spedified below, together with the pages on which they are described:

| Additives | RD No. 17643 | RD No. 18716 |
|---|---|---|
| 1. Chemical sensitizers | page 23 | page 648, right column |
| 2. Sensitivity increasing agents | | do |
| 3. Spectral sensitizers, super sentizers | page 23–24 | page 648, right column to page 649, right column |
| 4. Brighteners | page 24 | |
| 5. Antifoggants and stabilizers | pages 24–25 | page 649, right column |
| 6. Light absorbent, filter dye, ultraviolet absorbents | page 25–26 | page 649, right column to page 650, left column |
| 7. Anti-stain agent | page 25, right column | page 650, left to right columns |
| 8. Dye image stabilizer | page 25 | |
| 9. Hardening agents | page 26 | page 651, left column |
| 10. Binder | page 26 | do |
| 11. Plasticizers, lubricants | page 27 | page 650, right column |
| 12. Coating aids, | pages 26–27 | do |
| 13. Antistatic agents | page 27 | do |

In order to prevent degradation in photographic properties caused by formaldehyde gas, a compound described in U.S. Pat. Nos. 4,411,987 or 4,435,503, which can react with formaldehyde and fix the same, is preferably added to the light-sensitive material.

Various color couplers can be used in the present invention. Specific examples of these couplers are described in patents described in above-mentioned Research Disclosure (RD), No. 17643, VII-C to VII-G.

Preferable examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and European Patent 249,473A.

Examples of a magenta coupler are preferably 5-pyrazolone and pyrazoloazole compounds. Examples of these compounds are described in, e.g., U.S. Pat. Nos. 4,310,619 and 4,351,897, European Patent 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO No. 88/04795.

Examples of a cyan coupler are phenol and naphthol couplers. Of these, preferable are those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, Published European Patent Applications 3329729, 121365A and 249453A, U.S. Pat. Nos. 3,446,622, 4,333,999, 4,775,616, 4,451,559, 4,427,767, 4,690,889, 4,254,212, and 4,296,199, and JP-A-61-42658.

Preferable examples of a colored coupler for correcting additional, undesirable absorption of a colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as an elimination group described in U.S. Pat. No. 4,777,120 may be preferably used.

Preferable examples of a coupler capable of forming colored dyes having proper diffusibility are those described in U.S. Pat. No. 4,366,237, British Patent 2,125,570, European Patent 96,570, and West German Patent Application (OLS) No. 3,234,533.

Typical examples of polymerized, dye-forming couplers are disclosed in U.S. Pat. Nos. 3,451,820, 4,080,221, 4,367,288, 4,409,320 and 4,576,910, and British Patent 2,102,173.

Couplers each of which releases a photographically useful residue upon coupling are also preferably used in the present invention. DIR couplers, i.e., couplers releasing a development inhibitor are described in the patents cited in the above-described RD No. 17643, VII-F, JP-A-57-151944, JP-A-57-154234, JP-A-60-184248, JP-A-63-37346, JP-A-63-37350, and U.S. Pat. Nos. 4,248,962 and 4,782,012.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; a coupler releasing a dye which turns to a colored form after being released described in EP 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

In case that the light-sensitive material is applied to the color light-sensitive material, various types of antiseptics and fungicides are preferably added to the material. Examples of the antiseptics and the fungicides are phenetyl alcohol, and 1,2-benzisothiazoline3-one, n-butyl-p-hydroxybenzoate, phenol, 4-chloro-3, 5-dimethyl-phenol, 2-phenoxyethanol, and 2-(4-thiazolyl) benzimidazole described in JP-A-63-257747, JP-A-62-272248, and JP-A-1-80941.

A support which can be suitably used in the present invention is described in, e.g., RD. No. 17643, page 28, and RD. No. 18716, from the right column, page 647 to the left column, page 648.

In the light-sensitive material of the present invention, the sum total of film thicknesses of all hydrophilic colloidal layers at the side having emulsion layers is preferably 28 μm or less, more preferably, 23 μm or less, much more preferably, 20 μm or less. A film swell speed $T_{178}$ is preferably 30 sec. or less, and more preferably, 20 sec. or less. The film thickness means a film thickness measured under moisture conditioning at a temperature of 25° C. and a relative humidity of 55% (for two days). The film swell speed $T_{178}$ can be measured in accordance with a known method in the art. For example, the film swell speed $T_{\frac{1}{2}}$ can be measured by using a swell meter described in A. Green et al., "Photographic Science & Engineering," Vol. 19, No. 2, pp. 124 to 129. When 90% of a maximum swell film thickness reached by performing a treatment by using a color developing solution at 30° C. for 3 min. and 15 sec. is defined as a saturated film thickness, $T_{\frac{1}{2}}$ is defined as a time required for reaching ½ of the saturated film thickness.

The film swell speed $T_{\frac{1}{2}}$ can be adjusted by adding a film hardening agent to a gelatin as a binder or changing aging conditions after coating. A swell ratio is preferably 150% to 400%. The swell ratio is calculated from the maximum swell film thickness measured under the above conditions in accordance with a formula: (maximum swell film thickness - film thickness)/film thickness.

If the light-sensitive material according to the invention is a color photographic light-sensitive material, it can be developed by the ordinary method described in RD. No. 17643, pp. 28 and 29, and RD. No. 18716, p. 615, left column to right column.

To perform reversal processing on the material, the material is subjected to black and white development and then to color development. The black and white development is achieved by using a black and white developing solution containing one or more known black and white developing agents. Examples of the black and white developing agents are: dihydroxybenzenes such as hydroquinone; 3-pyrazolidones such as 1-phenyl-3-pyralidone; and aminophenols such as N-methyl-p-aminophenol.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, pp. 248-253 (May, 1955).

In the multi-stage counter-current scheme disclosed in this publication, reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial Agents and Fugicides", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antifungal Agents and Fungicides", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

In some cases, stabilizing is performed subsequently to washing. The stabilizing is, for example, performed in a formaline bath to be used as a final bath of the photographic color light-sensitive material for photography.

The present invention will be described in more detail, by way of its examples, but the present invention is not limited to these examples.

EXAMPLE 1

(1) Preparation of Emulsion

A. Preparation of Host Grains a Preparation of Emulsion A-1 (Seed Emulsion)

First, 1.5 l of an aqueous solution containing 0.2 g/l of potassium bromide and 30 g/l of gelatin was prepared. Then, an aqueous solution containing 0.94 mol/l of silver nitrate, and an aqueous solution containing 0.94 mol/l of potassium bromide were added by double-jet method to the aqueous solution containing potassium bromide and and gelatin while maintaing the pAg value at 7.3, thereby preparing Emulsion A-1 containing cubic silver bromide grains each of which has an equivalent-sphere diameter of 0.2 μm.

b. Preparation of Emulsion A-2

(Octahedral Host Grains)

An aqueous solution containing 1.6 mol/liter of silver nitrate and an aqueous solution containing 1.6 mol/liter of potassium bromide were added by double-jet method to 1 liter of aqueous solution containing Emulsion A-1 Containing 0.1 mol of Ag (calculated as an Ag atom) and 30 g of gelatin, while maintaining the temperature at 70° C. and the pAg value at 9. The amount of the silver nitrate used was 0.9 mol. The resultant solution was desalted by ordinary flocculation, thereby preparing Emulsion A-2, which contained octahedral grains each of which has an equivalent-sphere diameter of 0.4 μm.

c. Preparation of Emulsion A-3 (Cubic Host Grains)

Emulsion A-3 was prepared in the same way as Emulsion A-2, except that the pAg value was maintained at 7.3 during the forming of grains. Emulsion A-3 contained cubic grains having an equivalent-sphere diameter of 0.4 μm.

B. Preparation of Grains Having Dislocations a. Preparation of Emulsion B-2 (Octahedral grains having dislocations)

First, 500 g of Emulsion A-2 (0.5 mol of silver) and 350 cc of distilled water were mixed. The resultant solution was heated to 76° C. and stirred thoroughly. Next, an aqueous solution containing 0.04 mol/liter of silver nitrate and an aqueous solution containing 0.04 mol/liter of potassium iodide were added to the solution of Emulsion A-2, over 5 minutes. The amount in which silver nitrate and potassium iodide were added was equivalent to 3 mol % based on the silver contained in the host grains. Thereafter, an aqueous solution containing 1.6 mol/liter of silver nitrate, which was equivalent to 50 mol % of silver contained in the host grains, and an aqueous solution containing 1.6 mol/liter of potassium bromide, which was equivalent to 50 mol % of silver contained in the host grains, were added to the solution of of Emulsion A-2, over 60 minutes, while maintaining the pAg value at 9. Then, the resultant solution was desalted by means of ordinary flocculation, thereby obtaining Emulsion B-2. Emulsion B-2 contained octahedral grains each of which has an equivalent-sphere diameter of 0.46 μm.

b. Preparation of Emulsion B-2 (Cubic grains having dislocations)

Emulsion B-3 was prepared by the same method as Emulsion B-2, except that the host grains were replaced by those of Emulsion A-3, and the pAg value was maintained at 7.0 during the addition of silver nitrate and potassium bromide. Emulsion B-3, thus prepared, contained cubic grains each of which has an equivalent-sphere diameter of 0.46 μm.

C. Preparation of Grains Having Dislocations Concentrated in Regions Near the Apices a. Preparation of Emulsion C-2 (Octahedral grains having dislocations concentrated in regions near the apices)

First, 500 g of Emlusion A-2 as host grains (0.5 mol of silver) and 350 cc of distilled water were mixed. The result ant solution was heated to 40° C. and stirred thoroughly. Emulsion C-2 was prepared in the steps described below, while maintaining the temperature at 40° C.:

1 A solution containing 0.04 mol/liter of potassium iodide was added to the solution containing the host grains, over 15 minutes, in an amount equivalent to 1.2 mol % based on the silver contained in the host grains.

2. A solution containing 1.02 mol/liter of silver nitrate was added by double-jet method to the solution containing the host grains, over 1 minute, in an amount equivalent to 4.1 mol % based on the silver contained in the host grains, along with a solution containing 1.58 mol/liter of sodium chloride.

3. A solution containing 0.04 mol/liter of potassium iodide was added to the solution containing the host grains, over 8 minutes, in an amount equivalent to 3.0 mol % based on the silver contained in the host grain.

4. An aqueous solution containing 1.6 mol/liter of silver nitrate, which was equivalent to 50 mol % of silver contained in the host grains, and an aqueous solution containing 1.6 mol/liter of potassium bromide, which was equivalent to 50 mol % of silver contained in the host grains, were added to the solution containing the host grains over 60 minutes, while maintaining the pAg value at 9. Then, the resultant solution was desalted by means of ordinary flocculation.

Emulsion C-2, thus prepared contained octahedral grains each of which has an equivalent-sphere diameter of 0.46 μm.

b. Preparation of Emulsion C-3 (Cubic grains having dislocation in portions near the apices)

Emulsion C-3 was prepared by the same method as Emulsion C-2, except that the host grains were replaced by those of Emulsion A-3, and the pAg value was maintained at 7.0 during the addition of silver nitrate and potassium bromide. Emulsion C-3, thus prepared, contained cubic grains each of which has an equivalent-sphere diameter of 0.46 μm.

D. Preparation of Grains Having No Dislocation a. Preparation of Emulsion D-2 (Octahedral grains having no dislocation)

Emulsion D-2 was prepared by the same method as Emulsion B-2, except that no step was performed to form silver iodide. Emulsion D-2, thus prepared, contained octahedral grains.

b. Preparation of Emulsion D-3 (Cubic grains having no dislocation)

Emulsion D-3 was prepared by the same method as Emulsion B-3, except that no step was performed to form silver iodide. Emulsion D-3, thus prepared, contained cubic grains.

(2) Observation of Dislocations in Grains

Emulsions B-2, B-3, C-2, C-3, D-2, and D-3 were observed directly, by means of a transmission electron microscope, applying an acceleration voltage of 200 kV or more and maintaining the temperature within the microscope at −12° C.

Dislocation lines were found in the grains contained in Emulsions B-2, B-3, C-2, and C-3. In the case of Emulsions B-2 and B-3, dislocation lines were found in 80% or more all grains, dispersed at random in the grains. In the case of Emulsions C-2 and C-3, dislocation lines were found in 80% or more of all grains, concentrated in the regions near the apices of the grains.

(3) Chemical Sensitization

Sodium thiosulfate, potassium thiocyanate, and chlorauric acid were added to Emulsions B-2, B-3, C-2, C-3, D-2, and D-3, in such amounts that each of the emulsions might have most sensitivity when exposed to light for 1/100 second. Then, the emulsions were ripened for 60 minutes at 60° C.

(4) Shell-Forming to Render Emulsion Internally Latent-Image Type

An emulsion containing silver bromide grains each of which has an equivalent-sphere diameter of 0.02 μm, which was prepared apart from each of the emulsions described above, was added to each of Emulsions B-2, B-3, C-2, C-3, D-2 after these emulsions had been chemically sensitized. The resultant mixture emulsions were subjected to physical ripening for 10 minutes, thus forming shells on the grains.

More specifically, shells 5 nm thick were formed on the grains contained in Emulsion B-2, thereby preparing Emulsion E-1; shells 40 nm thick were formed on the grains in Emulsion B-2, thereby thus preparing Emulsion E-2; and shells 65 nm thick were formed on the grains in Emulsion B-2, thereby preparing Emulsion E-3. Also, shells 5 nm thick were formed on the grains contained in Emulsion D-2, thereby preparing Emulsion E-4; shells 40 nm thick were formed on the grains in Emulsion D-2, thereby preparing Emulsion E-5; and shells 65 nm thick were formed on the grains in Emulsion D-2, thereby preparing Emulsion E-6. Further, shells 40 nm thick were formed on the grains in Emulsion B-3, preparing Emulsion E-7, on the grains in Emulsion C-2, preparing Emulsion E-8, on the grains in Emulsion C-3, preparing Emulsion E-9, and on the grains in Emulsion D-3, preparing Emulsion E-10.

(5) Making Samples and Evaluation Thereof

The sensitizing dye represented by the following formula was added to each of Emulsions B-2, B-3, C-2, C-3, D-2, D-3, and E-1 to E-10, in an amount of $8.7\times10^{-4}$ mol/mol Ag. Each of the 16 emulsions was coated on undercoated triacetylcellulose film supports, thereby forming an emulsion layer thereon in a coating amount specified below. Further, a protective layer was coated on the emulsion layer in a coating amount specified below. As a result, Samples 1 to 16 were formed.

Sensitizing Dye

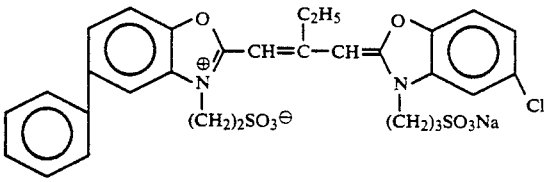

(1) Emulsion Layer
Emulsion specified above (silver: $3.6\times10^{-2}$ mol/m$^2$)
Coupler ($1.5\times10^{-3}$ mol/m$^2$)

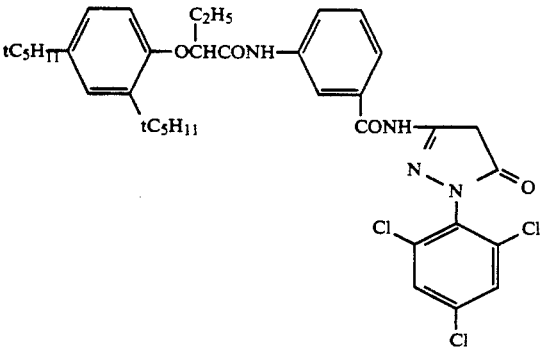

-continued

Sensitizing Dye

| | |
|---|---|
| Tricresylphosphate | (1.10 g/m$^2$) |
| Gelatin | (2.30 g/m$^2$) |
| (2) Protective Layer | |
| 2,4-dichloro-6-hydroxy-s-triazine sodium salt | (0.08 g/m$^2$) |
| Gelatin | (1.80 g/m$^2$) |

Samples 1 to 16 were left to stand at 40° C. and relative humidity of 70%, for 14 hours. Then, they were exposed for 1/100 second to the light applied through a continuous wedge. Next, they were color-developed in the method specified below.

Further, Samples 1 to 16 were stored for 1 month at 45° C. and relative humidity of 50%. Thereafter, they were exposed and developed in the same way as described above.

Samples 1 to 16, thus processed, were measured for their image densities, by means of a green filter.

Color-Developing Process

| Process | Time | Temperature |
|---|---|---|
| Color development | 2 min. 00 sec. | 40° C. |
| Bleach Fixing | 3 min. 00 sec. | 40° C. |
| Washing (1) | 20 sec. | 35° C. |
| Washing (2) | 20 sec. | 35° C. |
| Stabilization | 20 sec. | 35° C. |
| Drying | 50 sec. | 65° C. |

The compositions of the solutions used in the color-developing process are as follows:

| (Color Developing Solution) | (unit g) |
|---|---|
| Diethylenetriaminepentaacetate | 2.0 |
| 1-hydroxyethylidene-1,1-diphosphonate | 3.0 |
| Sodium sulfide | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-β-hydroxylethylamino]-2-methylaniline sulfate | 4.5 |
| Water to make | 1.0 liter |
| pH | 10.05 |

| (Bleach Fising Solution) | (g) |
|---|---|
| Ferric ethylenediamine-tetraacetate ammonium dihydrate | 90.0 |
| Disodium ethylendiamine-tetraacetate | 5.0 |
| Sodium sulfite | 1.20 |
| Aqueous solution of ammonium thiosulfate | 260.0 ml |
| Acetic acid (98%) | 5.0 ml |
| Bleaching accelerator | 0.01 mol |

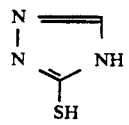

| | |
|---|---|
| Water to make | 1.0 liter |
| pH | 6.0 |

Washing Solution

Use was made of a washing solution which had been prepared as follows. First, tap water was passed through a mixed-bed column filled with H-type strong-acideic cation exchange-resin (Amberlite IR-120B) and OH-type anion exchange-resin (Amberlite IRA-400), both resins made by manufactured by Rome and Harse, Inc., whereby concentrations of the calcium and magnesium ion were reduced to 3 mg/l or less. Next, 20 mg/l of sodium isocyanuric dichloride and 1.5 mg/l of sodium sulfate were added to the water thus processed, thereby obtaining the washing solution. The washing solution had pH value ranging from 6.5 to 7.5.

-continued

| (Composition of the Solution) | |
|---|---|
| Potassium bromide | 1 g |
| Water to make | 1 l (pH: 9.6) |

The amount of sodium thiosulfate was changed from 0 to 10 g/liter, thereby determining the relationship which y had with the depth x of the latent image in the silver halide grains, which was developed during said processing. The value of x, at which y was maximal, was defined as the depth at which the sensitivity specks are distributed.

The results were as is shown in the following Table 1:

TABLE 1

| Sample | Emulsion | Shape of grain | Dislocation | Depth (nm) at which the specks are distributed with the maximal value | Sensitivity (One day later) | Sensitivity (One month later) | |
|---|---|---|---|---|---|---|---|
| 1 | B-2 | Octahedral | present | — | 100 | 79 | Comparative |
| 2 | B-3 | Cubic | " | — | 106 | 84 | " |
| 3 | C-2 | Octahedral | " | — | 105 | 83 | " |
| 4 | C-3 | Cubic | " | — | 110 | 85 | " |
| 5 | D-2 | Octahedral | None | — | 65 | 48 | " |
| 6 | D-3 | Cubic | " | — | 79 | 60 | " |
| 7 | E-1 | Octahedral | present | 3 | 133 | 124 | Invention |
| 8 | E-2 | " | " | 40 | 136 | 132 | " |
| 9 | E-3 | " | " | 65 | 100 | 98 | Comparative |
| 10 | E-4 | " | None | 5 | 72 | 59 | " |
| 11 | E-5 | Octahedral | None | 46 | 75 | 67 | Comparative |
| 12 | E-6 | " | " | 70 | 62 | 55 | " |
| 13 | E-7 | Cubic | present | 42 | 158 | 154 | Invention |
| 14 | E-8 | Octahedral | " | 40 | 141 | 134 | " |
| 15 | E-9 | Cubic | " | 51 | 165 | 162 | " |
| 16 | E-10 | " | None | 39 | 94 | 84 | Comparative |

| (Stabilizing Solution) | (g) |
|---|---|
| Formalin (37%) | 2.2 ml |
| Polyoxyethylene-p-monopheyl ether (average polymerization degree: 10) | 0.3 |
| Disodium ethylenediamine tetraacetate | 0.05 |
| Water to make | 1.0 liter |
| pH | 5.0 to 8.0 |

The sensitivities of Samples 1 to 16 were masured in terms of the relative logarithmic value of the reciprocal of the exposure amount (in lux·second) which imparted a fog density of 0.2. (The sensitivity which Sample 1 exhibited one day after the coating process was used as reference.)

Also, the depth at which the distribution of sensitivity specks was maximal in each of Samples 1 to 16 was determined in the following method.

First, each sample was exposed to white light for 1/100 second. Then, the sample was processed as specified below. The exposure amount which imparted a fog density of +0.1 was detected. The reciprocal of the exposure amount, thus detected, was used as y.

The method of determining the distribution of sensitivity specks was to add 0 to 10 g/liter of sodium thiosulfate to a solution of the following composition, and to process the solution at 20° C. for 7 minutes.

| (Composition of the Solution) | |
|---|---|
| N-methyl-p-aminophenol sulfate | 2.5 g |
| Sodium L-ascorbate | 10 g |
| Sodium methaborate | 35 g |

As is evident from Table 1, Emulsions E-1, E-2, E-7, E-8, and E-9, all according to the present invention, had sensitivities much higher than those of the other Emulsions which are comparative examples. As can be understood from Table 1, too, the emulsions of this invention had their sensitivities decreased only a little during their storage.

In comparison with Emulsion B-2, each of Emulsions E-1, E-2, and E-3, obtained by forming shells on the grains of Emulsion B-2, exhibited high sensitivity and high storage stability since the sensitivity specks existed in the internal portion of each grain by virtue of the shell formed, particularly in the case where the shell had a thickness of 2 nm or more thick and less than 50 nm.

The same can be said of Emulsions E-4, E-5, E-6, each prepared by forming shells on the grains of Emulsion D-2, in comparison with Emulsion D-2.

Further, as comparison of Emulsions B-2, E-2, D-2 and E-5 reveals, it was found that the grains having dislocation lines served to enhance the sensitivity and storage stability of the emulsion more greatly, by introducing the sensitivity specks existed in the internal portion of the grain, owing to the shell formed. Also, as comparison of Emulsions B-2, B-3, C-2 and C-3 with Emulsions E-2, E-7, E-8 and E-9 demonstrates, the sensitivity specks located in the internal portions of cubic grains having dislocation lines achieve a greater advantage than those located in the internal portions of any other regular grains. This advantage was more prominent than the advantage which might had been achieved if sensitivity specks were concentrated in the internal portions of the grains of Emulsions D-2, D-3, E-5 and E-10, which had no dislocation line at all.

EXAMPLE 2

A plurality of layers of the composition specified below were coated on undercoated triacetylcellulose film supports, forming eight types of color light-sensitive materials (hereinafter referred to as "Samples 101 to 108").

Compositions of light-sensitive layers

Numerals corresponding to each component indicates a coating amount represented in units of g/m$^2$. The coating amount of a silver halide or a colloidal silver is represented by the coating amount of silver. The coating amount of a coupler, an additive, or gelatin is represented by the amount in units g/m$^2$. The coating amount of a sensitizing dye is represented in units of moles per mole of a silver halide in the same layer.

| | |
|---|---|
| Layer 1: Antihalation layer | |
| Black colloidal silver | 0.15 |
| Gelatin | 1.90 |
| ExM-8 | $2.0 \times 10^{-2}$ |
| Layer 2: Interlayer | |
| Gelatin | 2.10 |
| UV-1 | $3.0 \times 10^{-2}$ |
| UV-2 | $6.0 \times 10^{-2}$ |
| UV-3 | $7.0 \times 10^{-2}$ |
| ExF-1 | $4.0 \times 10^{-3}$ |
| Solv-2 | $7.0 \times 10^{-2}$ |
| Layer 3: Low red-sensitive emulsion layer | |
| Silver bromoiodide emulsion (AgI content: 2 mol %; internally high-AgI type; equivalent-sphere diameter: 0.3 μm; variation coefficient in terms of equivalent-sphere diameter: 29%; regular crystal and twined crystal-mixed grains; diameter/thickness ratio of 2.5) | silver 0.50 |
| Gelatin | 1.50 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.22 |
| ExC-4 | $3.0 \times 10^{-2}$ |
| Solv-1 | $7.0 \times 10^{-3}$ |
| Layer 4: Medium red-sensitive emulsion layer | |
| Silver bromoiodide emulsion (AgI content: 4 mol %; internally high-AgI type; equivalent-sphere diameter: 0.55 μm; variation coefficient in terms of equivalent-sphere diameter: 20%; regular crystal and twined crystal-mixed grains having diameter/thickness ratio of 1.0) | silver 0.85 |
| Gelatin | 2.00 |
| ExS-1 | $1.0 \times 10^{-4}$ |
| ExS-2 | $3.0 \times 10^{-4}$ |
| ExS-3 | $1.0 \times 10^{-5}$ |
| ExC-2 | $8.0 \times 10^{-2}$ |
| ExC-3 | 0.33 |
| ExY-13 | $2.0 \times 10^{-2}$ |
| ExY-14 | $1.0 \times 10^{-2}$ |
| Cpd-10 | $1.0 \times 10^{-4}$ |
| Solv-1 | 0.10 |
| Layer 5: High red-sensitive emulsion layer | |
| Silver bromoiodide emulsion (AgI content: 10 mol %; internally high-AgI type; equivalent-sphere diameter: | silver 0.70 |

-continued

| | |
|---|---|
| 0.7 μm; variation coefficient in terms of equivalent-sphere diameter: 30%; twined crystal mixed grains; diameter/thickness ratio of 1.0) | |
| Gelatin | 1.60 |
| ExS-1 | $1.0 \times 10^{-4}$ |
| ExS-2 | $3.0 \times 10^{-4}$ |
| ExS-3 | $1.0 \times 10^{-5}$ |
| ExC-5 | $7.0 \times 10^{-2}$ |
| ExC-6 | $8.0 \times 10^{-2}$ |
| Solv-1 | 0.15 |
| Solv-2 | $8.0 \times 10^{-2}$ |
| Layer 6: Interlayer | |
| Gelatin | 1.10 |
| P-2 | 0.17 |
| Cpd-1 | 0.10 |
| Cpd-4 | 0.17 |
| Solv-1 | $5.0 \times 10^{-2}$ |
| Layer 7: Low green-sensitive emulsion layer | |
| Silver bromoiodide emulsion (AgI content: 2 mol %; internally high-AgI type; equivalent-sphere diameter: 0.3 μm; variation coefficient in terms of equivalent-sphere diameter: 28%; regular crystal and twined crystal-mixed grains; dameter/thickness ratio of 2.5) | silver 0.30 |
| Gelatin | 0.50 |
| ExS-4 | $5.0 \times 10^{-4}$ |
| ExS-5 | $2.0 \times 10^{-4}$ |
| ExS-6 | $0.3 \times 10^{-2}$ |
| ExM-8 | $3.0 \times 10^{-2}$ |
| ExM-9 | 0.20 |
| ExY-13 | $3.0 \times 10^{-2}$ |
| Cpd-11 | $7.0 \times 10^{-3}$ |
| Solv-1 | 0.20 |
| Layer 8: Medium green-sensitive emulsion layer | |
| Emulsion of the invention (B-2, B-3, D-2, D-3, E-2, E-5, E-7, or E-10) | silver 0.60 |
| Gelatin | 1.00 |
| ExS-4 | $5.0 \times 10^{-4}$ |
| ExS-5 | $2.0 \times 10^{-4}$ |
| ExS-6 | $3.0 \times 10^{-4}$ |
| ExM-8 | $3.0 \times 10^{-2}$ |
| ExM-9 | 0.25 |
| ExM-10 | $1.5 \times 10^{-2}$ |
| ExY-13 | $4.0 \times 10^{-2}$ |
| Cpd-11 | $9.0 \times 10^{-3}$ |
| Solv-1 | 0.20 |
| Layer 9: High green-sensitive emulsion layer | |
| Silver bromoiodide emulsion (AgI content: 10 mol %; internally high-AgI type; equivalent-sphere diameter: 0.7 μm; variation coefficient in terms of equivalent-sphere diameter: 30%; regular crystal and twined crystal-mixed grains; diameter/thickness ratio of 2.0) | silver 0.50 |
| Gelatin | 0.90 |
| ExS-4 | $2.0 \times 10^{-4}$ |
| ExS-5 | $2.0 \times 10^{-4}$ |
| ExS-6 | $2.0 \times 10^{-5}$ |
| ExS-7 | $3.0 \times 10^{-4}$ |
| ExM-8 | $2.0 \times 10^{-2}$ |
| ExM-11 | $6.0 \times 10^{-2}$ |
| ExM-12 | $2.0 \times 10^{-2}$ |
| Cpd-2 | $1.0 \times 10^{-2}$ |
| Cpd-9 | $2.0 \times 10^{-4}$ |
| Cpd-10 | $2.0 \times 10^{-4}$ |
| Solv-1 | 0.20 |
| Solv-2 | $5.0 \times 10^{-2}$ |
| Layer 10: Yellow filter layer | |

-continued

| | |
|---|---|
| Gelatin | 0.90 |
| Yellow colloid | $5.0 \times 10^{-2}$ |
| Cpd-1 | 0.20 |
| Solv-1 | 0.15 |
| Layer 11: Low blue-sensitive emulsion layer | |
| Silver bromoiodide emulsion (AgI content: 4 mol%; internally high-AgI type; equivalent-sphere diameter: 0.5 μm; variation coefficient in terms of equivalent-sphere diameter: 15%; octahedral grains) | silver 0.40 |
| Gelatin | 1.00 |
| ExS-8 | $2.0 \times 10^{-4}$ |
| ExY-13 | $9.0 \times 10^{-2}$ |
| Ex-Y15 | 0.90 |
| Cpd-2 | $1.0 \times 10^{-2}$ |
| Solv-1 | 0.30 |
| Layer 12: High blue-sensitive emulsion layer | |
| Silver bromoiodide emulsion (AgI content: 10 mol %; internally high-AgI type; equivalent-sphere diameter: 1.3 μm; variation coefficient in terms of equivalent-sphere diameter: 25%; regular crystal and twined crystal mixed grains; diameter/thickness ratio of 4.5) | silver 0.50 |
| Gelatin | 0.60 |
| ExS-8 | $1.0 \times 10^{-4}$ |
| ExY-15 | 0.12 |
| Cpd-2 | $1.0 \times 10^{-3}$ |
| Solv-1 | $4.0 \times 10^{-2}$ |
| Layer 13: First protective layer | |
| Fine silver bromoiodide grains (av. grain size: 0.07 μm, AgI content: 1 mol %) | 0.20 |
| Gelatin | 0.80 |
| UV-2 | 0.10 |
| UV-3 | 0.10 |
| UV-4 | 0.20 |
| Solv-3 | $4.0 \times 10^{-2}$ |
| P-2 | $9.0 \times 10^{-2}$ |
| Layer 14: Second protective layer | |
| Gelatin | 0.90 |
| R-1 (diameter: 1.5 μm) | 0.10 |
| R-2 (diameter: 1.5 μm) | 0.10 |
| R-3 | $2.0 \times 10^{-2}$ |
| H-1 | 0.40 |

Compounds Cpd-3, Cpd-5, Cpd-6, Cpd-7, Cpd-8, P-1, W-1, W-2, and W-3, all specified below, were added to Samples 101 to 108, to prepare the emulsions have improved storage stability, be more readily processed, be more resistant to pressure, be more antibacterial and more antifungal, be better protected against electrical charging, and be more readily coated. Further, n-butyl-p-hydroxybenzoate was added to the samples. Still further, Samples 101 to 108 contained compounds B-4, F-1, F-4, F-5, F-6, F-7, F-8, F-9, F-10, F-11, and F-13, iron salt, lead salt, gold salt, platinum salt, iridium salt, and rohdium salt.

The structures of the compounds identified above by alphanumeric notation will be specified in Table A (later presented).

Samples 101 to 108 of a set, thus prepared, were exposed to light and developed in the same way as of Example 1.

Samples 101 to 108 of another set were left to stand for 7 days in a storage chamber maintained at 50° C. and relative humidity of 30%, and then exposed to light and developed in the same way as Example 1.

The sensitivity of each sample of either set was evaluated in terms of the reciprocal of the exposure amount which imparted the sample a color density 1.0 higher than the minimum magenta density measured by means of a green filter. The results were as is shown in the following Table 2:

TABLE 2

| Sample | Emulsion in layer 8 | Sensitivity | Sensitivity (7 days later) | Remarks |
|---|---|---|---|---|
| 101 | B-2 | 100 | 72 | Comparative |
| 102 | B-3 | 103 | 68 | " |
| 103 | D-2 | 67 | 42 | " |
| 104 | D-3 | 81 | 57 | " |
| 105 | E-2 | 139 | 118 | Invention |
| 106 | E-5 | 74 | 56 | Comparative |
| 107 | E-7 | 154 | 150 | Invention |
| 108 | E-10 | 93 | 77 | Comparative |

As is clearly seen from Table 2, Samples 105 and 107, both falling within the scope of the present invention, were much more sensitive than the comparative samples. Also, the sensitivities of Samples 105 and 107 decreased but very little during the 7-day storage of these samples.

As has been described above, the present invention can provide a silver halide photographic light-sensitive material which contains regular silver halide grains which have high sensitivity achieved by increasing latent-image forming efficiency, not light absorption, and which has a high storage stability.

TABLE A

UV-1

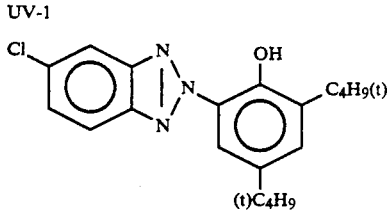

UV-2

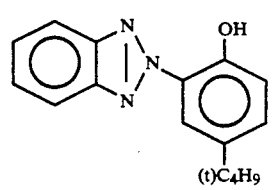

UV-3

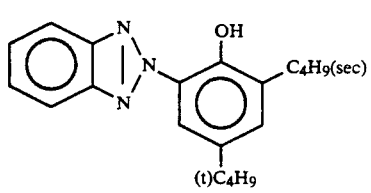

UV-4

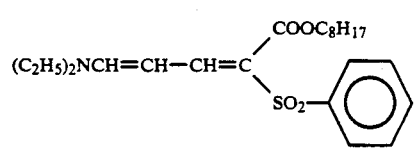

TABLE A-continued
Solv-1 tricresylphosphate
Solv-2 dibutylphthalate
Solve-3 tri(2-ethylhexyl)phosphate
ExF-1
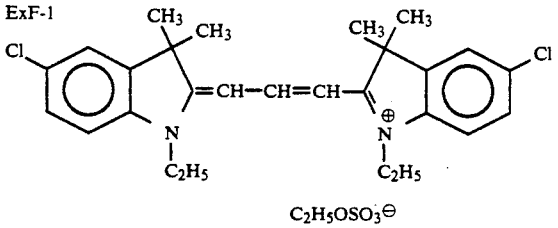
ExC-2
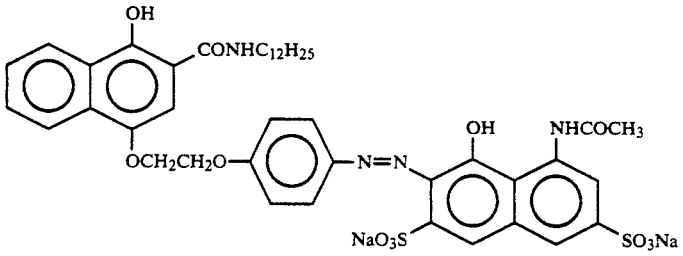
ExC-3
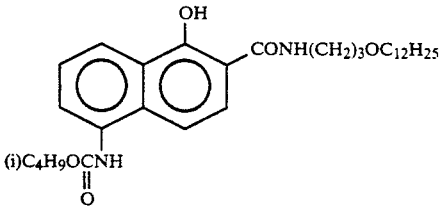
ExC-4
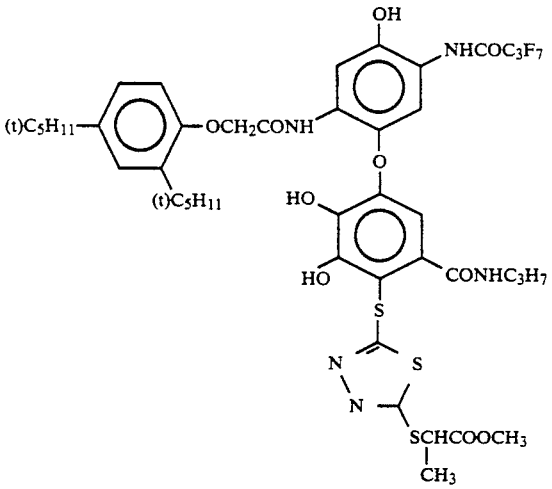
ExC-5
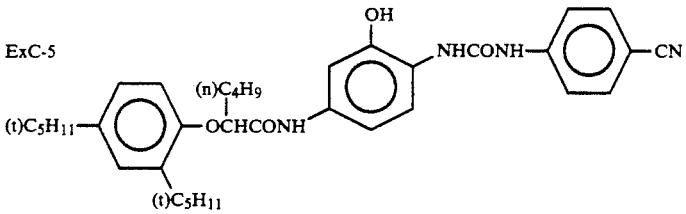
ExC-6
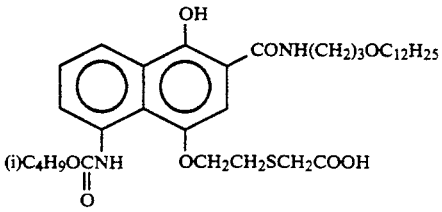

TABLE A-continued
ExM-8
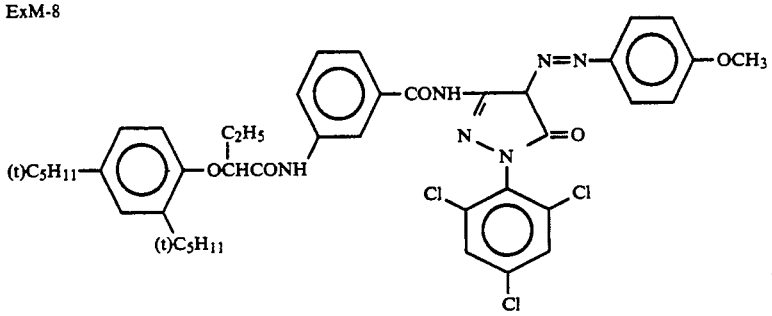
ExM-9
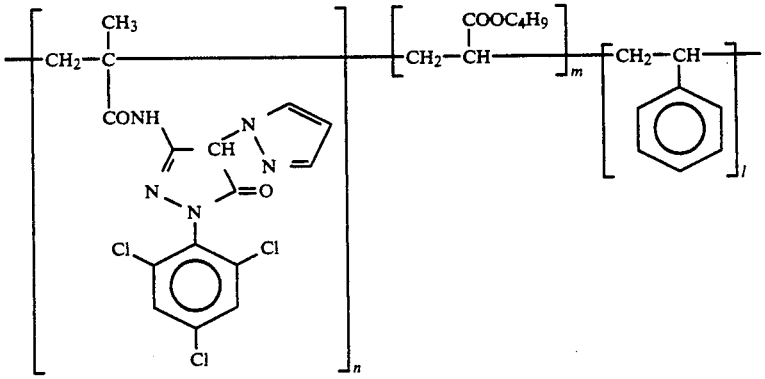
n/m/l = 50/25/25
(weight ratio)
Average molecular weight 20,000
ExM-10
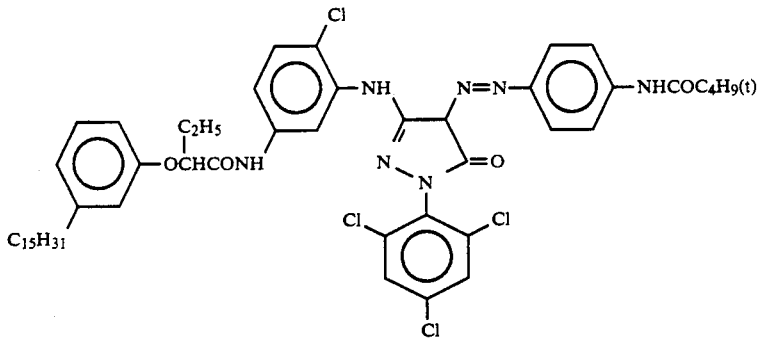
ExM-11
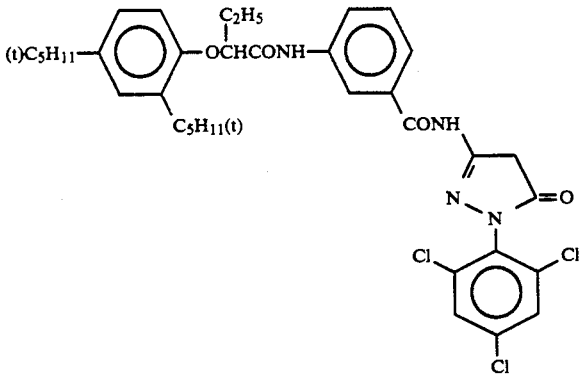

TABLE A-continued
ExM-12
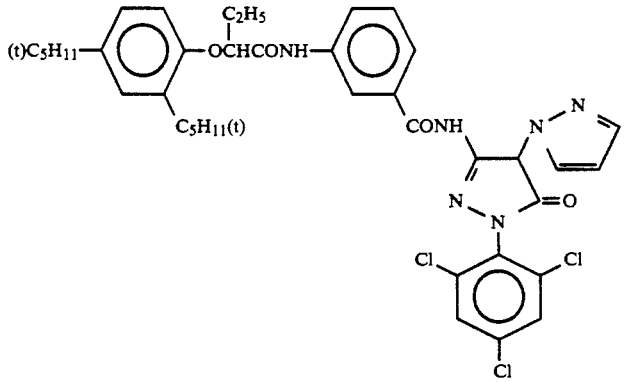
ExY-13
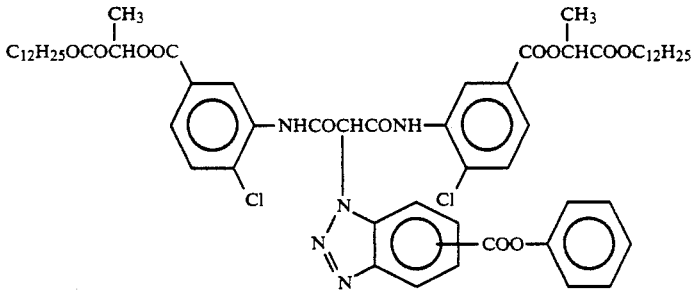
Exy-14
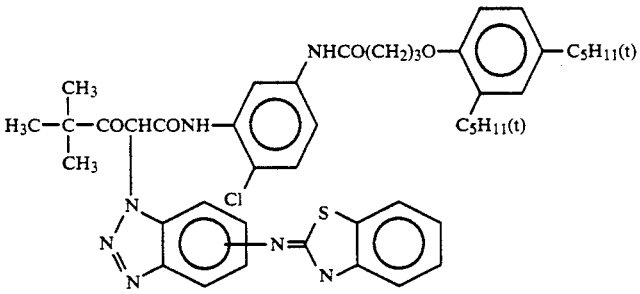
ExY-15
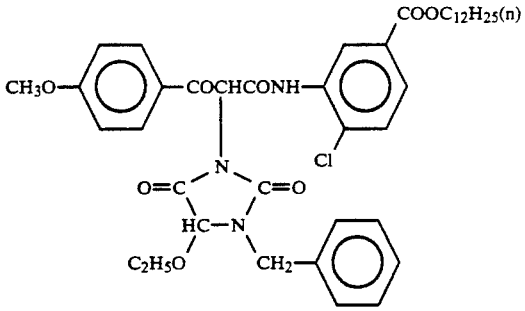
Cpd-1
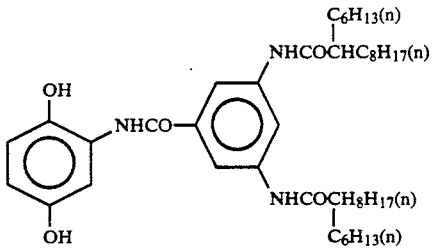
Cpd-2
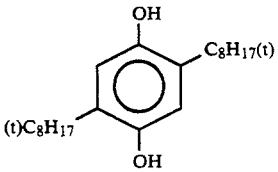
Cpd-3
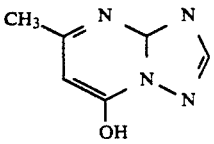

TABLE A-continued
Cpd-4
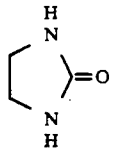
Cpd-5
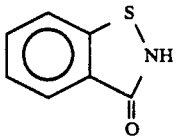
Cpd-6
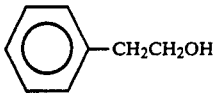
Cpd-7
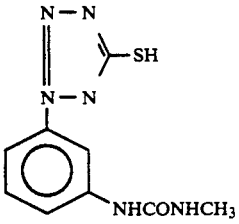
Cpd-8
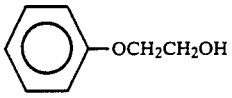
Cpc-9
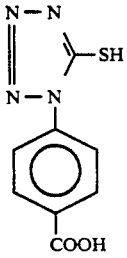
Cpc-10
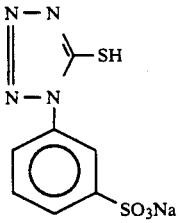
Cpd-11
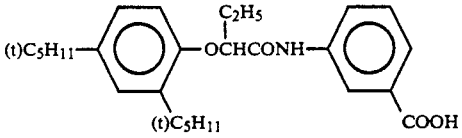
ExS-1
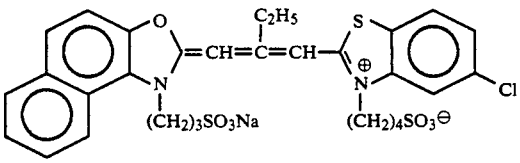
ExS-2
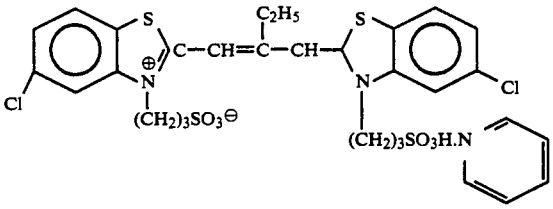
ExS-3
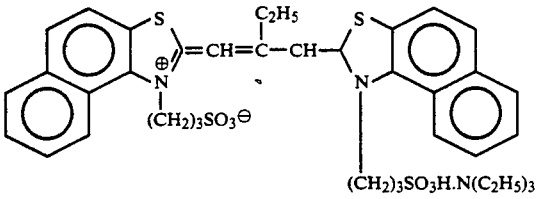
ExS-4
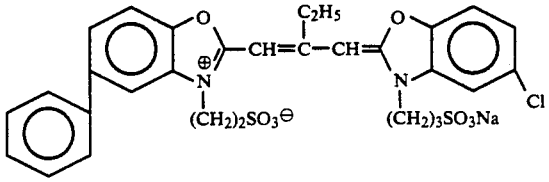

TABLE A-continued
ExS-5
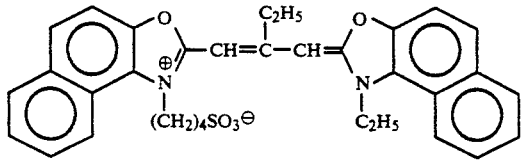
ExS-6
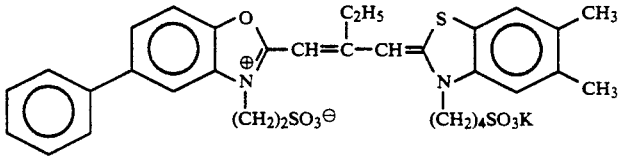
ExS-7
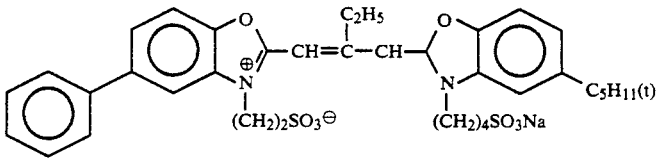
ExS-8
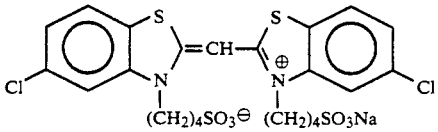
B-4
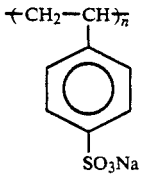
H-1
$CH_2{=}CH{-}SO_2{-}CH_2{-}CONH{-}CH_2$
$CH_2{=}CH{-}SO_2{-}CH_2{-}CONH{-}CH_2$
W-1
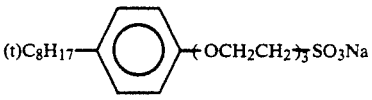
W-2
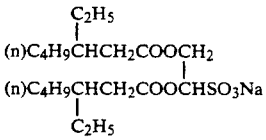
W-3
$C_8F_{17}SO_2N(C_3H_7)CH_2COOK$
P-1
Copolymer of vinyl pyrrolidone and vinyl alcohol
(Copolymer composition = 70:30 (weight ratio))
P-2
polyethylacrylate
F-1
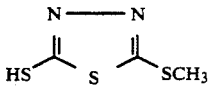
F-4
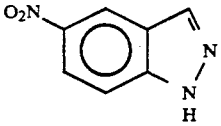
F-5
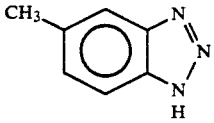
F-6
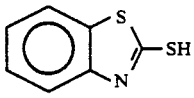

TABLE A-continued

F-7

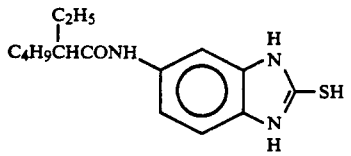

F-8

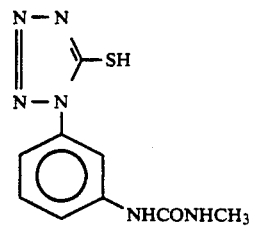

F-9

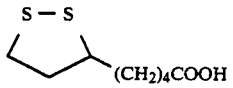

F-10

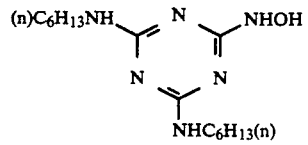

F-11

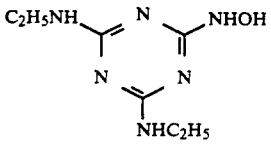

F-13

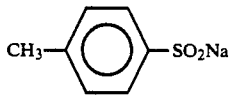

R-1

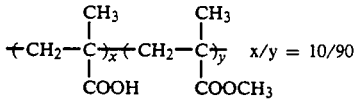

R-2

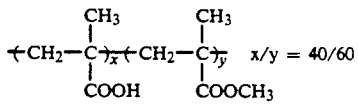

R-3

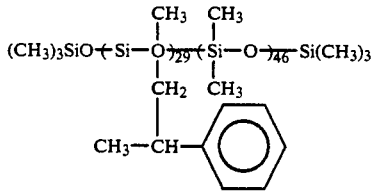

What is claimed is:

1. A silver halide photographic light-sensitive material comprising:

a support; and a plurality of silver halide emulsion layers formed on the support, at least one of the emulsion layers containing regular silver halide grains, wherein at least 30% of the regular silver halide grains have at least 10 dislocation lines, and wherein the dislocation lines are formed concentratedly in a region near an apex in each of the regular grains, and wherein sensitivity specks are present in each of the grains having dislocation lines, said sensitivity specks being distributed with a maximal value at a depth of from about at least 2 nm to about 50 nm from the surface of the silver halide grain.

2. The silver halide photographic light-sensitive material according to claim 1, wherein each of the regular silver halide grains has a surface comprising, mainly, a (100) face.

3. The silver halide photographic light-sensitive material according to claim 2, wherein the ratio of the area of the (100) face to the entire surface area of the grain is 80% or more.

4. The silver halide photographic light-sensitive material according to claim 1, wherein the size distribution of the regular grains has a variation coefficient of about 20% or less.

5. The silver halide photographic light-sensitive material according to claim 1, wherein the dislocation lines are introduced into each of the regular grains by epitaxially joining silver iodide or silver halide having a high silver iodide content to the apex of the grain by means of halogen conversion.

6. The silver halide photographic light-sensitive material according to claim 1, wherein dislocations are introduced into each of the regular silver halide grains by a process comprising the steps of:

growing a silver halide having a high AgI content on (1) a silver bromoiodide host grain containing at most 10 mol % of silver iodide or (2) a silver bromochloroiodide host grain containing at most 10 mol % of silver iodide and at most 3 mol % of silver chloride, the silver halide comprising (1) silver bromoiodide containing at least 30 mol % of silver iodide or (2) silver bromochloroiodide containing at least 30 mol % of silver iodide and at most 5 mol % of silver chloride; and covering the silver halide having a high AgI content with a silver halide shell having a low AgI content comprising (1) a silver bromoiodide containing at most 6 mol % of silver iodide or (2) a silver bromochloroiodide containing at most 6 mol % of silver iodide and at most 1 mol % of silver chloride.

7. The silver halide photographic light-sensitive material according to claim 2, wherein dislocations are introduced into each of the regular silver halide grains by a process comprising the steps of:

growing a silver halide having a high AgI content on (1) a silver bromoiodide host grain containing at most 10 mol % of silver iodide or (2) a silver bromochloroiodide host grain containing at most 10 mol % of silver iodide and at most 3 mol % of silver chloride, the silver halide comprising (1) silver bromoiodide containing at least 30 mol % of silver iodide or (2) silver bromochloroiodide containing at least 30 mol % of silver iodide and at most 5 mol % of silver chloride; and covering the silver halide having a high AgI content with a silver halide shell having a low AgI content comprising (1) a silver bromoiodide containing at most 6 mol % of silver iodide or (2) a silver bromochloroiodide containing at most 6 mol % of silver iodide and at most 1 mol % of silver chloride.

8. The silver halide photographic light-sensitive material according to claim 3, wherein dislocations are introduced into each of the regular silver halide grains by a process comprising the steps of:

growing a silver halide having a high AgI content on (1) a silver bromoiodide host grain containing at most 10 mol % of silver iodide or (2) a silver bromochloroiodide host grain containing at most 10 mol % of silver iodide and at most 3 mol % of silver chloride, the silver halide comprising (1) silver bromoiodide containing at least 30 mol % of silver iodide or (2) silver bromochloroiodide containing at least 30 mol % of silver iodide and at most 5 mol % of silver chloride; and covering the silver halide having a high AgI content with a silver halide shell having a low AgI content comprising (1) a silver bromoiodide containing at most 6 mol % of silver iodide or (2) a silver bromochloroiodide containing at most 6 mol % of silver iodide and at most 1 mol % of silver chloride.

9. The silver halide photographic light-sensitive material according to claim 4, wherein dislocations are introduced into each of the regular silver halide grains by a process comprising the steps of:

growing a silver halide having a high AgI content on (1) a silver bromoiodide host grain containing at most 10 mol % of silver iodide or (2) a silver bromochloroiodide host grain containing at most 10 mol % of silver iodide and at most 3 mol % of silver chloride, the silver halide comprising (1) silver bromoiodide containing at least 30 mol % of silver iodide or (2) silver bromochloroiodide containing at least 30 mol % of silver iodide and at most 5 mol % of silver chloride; and covering the silver halide having a high AgI content with a silver halide shell having a low AgI content comprising (1) a silver bromoiodide containing at most 6 mol % of silver iodide or (2) a silver bromochloroiodide containing at most 6 mol % of silver iodide and at most 1 mol % of silver chloride.

* * * * *